US010288389B1

(12) United States Patent
Wadsworth

(10) Patent No.: US 10,288,389 B1
(45) Date of Patent: May 14, 2019

(54) IMPACT TRIGGERED DYNAMIC TARGET SYSTEM

(71) Applicant: Mark Anthony Wadsworth, Sedan, KS (US)

(72) Inventor: Mark Anthony Wadsworth, Sedan, KS (US)

( * ) Notice: Subject to any disclaimer, the term of this patent is extended or adjusted under 35 U.S.C. 154(b) by 0 days.

(21) Appl. No.: 16/118,210

(22) Filed: Aug. 30, 2018

(51) Int. Cl.

| | |
|---|---|
| ***F41J 9/00*** | (2006.01) |
| ***F41J 7/00*** | (2006.01) |
| ***F41J 5/22*** | (2006.01) |
| ***F41J 9/02*** | (2006.01) |
| *F41J 1/10* | (2006.01) |

(52) U.S. Cl.
CPC . *F41J 5/22* (2013.01); *F41J 7/00* (2013.01); *F41J 9/02* (2013.01); *F41J 1/10* (2013.01); *F41J 9/00* (2013.01)

(58) Field of Classification Search
CPC ..... F41J 9/00; F41J 1/10; F41J 7/00
USPC ..... 273/406, 407, 383, 385–388
See application file for complete search history.

(56) References Cited

U.S. PATENT DOCUMENTS 1,378,340 A * 5/1921 Fairchild ..... F41J 5/26 273/380
1,723,826 A * 8/1929 Van Auken ..... F41J 5/18 273/380
2,125,353 A 8/1938 Mattson
2,215,917 A * 9/1940 Dreyer ..... F41J 9/02 273/366
2,297,993 A * 10/1942 Tratsch ..... F41J 7/04 273/366
3,823,939 A * 7/1974 Bottorff ..... A63B 63/06 273/359
4,699,116 A * 10/1987 Freeland ..... F41J 9/18 124/32
5,087,053 A * 2/1992 Head ..... F41J 3/0004 273/359
5,257,790 A 11/1993 Meadows
5,261,674 A * 11/1993 Allison ..... F41J 1/01 124/1
6,257,583 B1 7/2001 Roberson
6,913,263 B2 * 7/2005 Fort, II ..... F41J 1/10 273/406
7,293,774 B1 11/2007 Shawd et al.
7,556,268 B2 7/2009 Bateman et al.
7,735,832 B2 6/2010 Bliehall
8,152,527 B2 4/2012 Kobett
(Continued)

*Primary Examiner* — Mark S Graham
(74) *Attorney, Agent, or Firm* — Olav M. Underdal; IDP Patent Services

(57) ABSTRACT

An impact triggered dynamic target system includes, a target body with legs that can be ground spikes; a target release assembly, including a target holder including first and second holder pegs; a primary target assembly, including a primary target disc, a secondary target pusher including first and second secondary target pushers, and first and second target sliders slidably mounted on the first and second holder pegs, and a plurality of secondary target discs; a rolling track with a rolling surface and first and second side rails; and a projectile receptacle, such that a practice shooter shoots that the primary target disc, which releases a secondary target disc, which rolls down the rolling track and off the impact triggered dynamic target system, such that the practice shooter can shoot at the rear disc, while the rear disc is rolling on an adjacent ground surface.

20 Claims, 11 Drawing Sheets

(56) References Cited

U.S. PATENT DOCUMENTS

| | | | | |
|---|---|---|---|---|
| 8,910,944 | B2 | 12/2014 | Mason | |
| 8,919,778 | B2 * | 12/2014 | Fodera | F41J 1/10 273/380 |
| 10,024,637 | B1 * | 7/2018 | Li | F41J 7/02 |
| 2005/0006848 | A1 * | 1/2005 | Fort, II | F41J 1/10 273/407 |
| 2013/0241152 | A1 * | 9/2013 | Fodera | F41J 1/10 273/407 |
| 2015/0268013 | A1 | 9/2015 | Heise | |

* cited by examiner

Impact Triggered Dynamic Target System

IMPACT TRIGGERED DYNAMIC TARGET SYSTEM

CROSS-REFERENCE TO RELATED APPLICATIONS

N/A.

FIELD OF THE INVENTION

The present invention relates generally to the field of target shooting, and more particularly to methods and systems for target shooting with dynamic targets.

BACKGROUND OF THE INVENTION

Target systems are commonly used for shooting practice by both professional and recreational users. Most such systems present a static target, and therefore may not offer adequate training for real-world scenarios, wherein targets are often moving.

Dynamic target systems with moving targets are available, but they are generally complex in construction and therefore costly and often difficult to install, and may also provide only limited target movement.

As such, considering the foregoing, it may be appreciated that there continues to be a need for novel and improved devices and methods for dynamic target systems.

SUMMARY OF THE INVENTION

The foregoing needs are met, to a great extent, by the present invention, wherein in aspects of this invention, enhancements are provided to the existing model of dynamic target systems.

In an aspect, an impact triggered dynamic target system can include:

a) a target body; and b) a target release assembly, which can be mounted to an upper part of the target body, such that the target release assembly can include:

a target holder;

a primary target assembly, including:

a primary target disc;

a plurality of secondary target discs, which can be horizontally stacked adjacent to a rear end of the primary target assembly, such that a front disc of the secondary target discs can be immediately adjacent to a rear end of the primary target assembly;

such that the primary target assembly and the secondary target discs can be slidably connected to the target holder;

c) a rolling track, which can be connected to and/or integral with the target body, the rolling track comprising a rolling surface;

d) a projectile receptacle, which can be configured to receive a projectile;

such that when the primary target disc is impacted by a projectile, the primary target disc thereby pushes the primary target assembly rearward, such that the primary target assembly can impact with the front disc, and push the front disc rearward, which pushes the secondary target discs rearward, such that a rear disc of the secondary target discs is pushed rearward into a rear wall of the rolling track, such that the rear disc enters an entry region without vertical support from the target holder, such that the rear disc falls down into the rolling track, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter can shoot at the rear disc, while the rear disc is rolling on the ground surface.

In a related aspect, the primary target disc can be configured with a marking to indicate a target area, and designed such that an impact with the projectile will only cause release of the rear disc when the projectile impacts with the primary target disc within the target area.

In another related aspect, the rolling surface can be configured as a substantially elliptical or parabolic curve, which changes smoothly from an initial rolling angle to an exit rolling angle.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
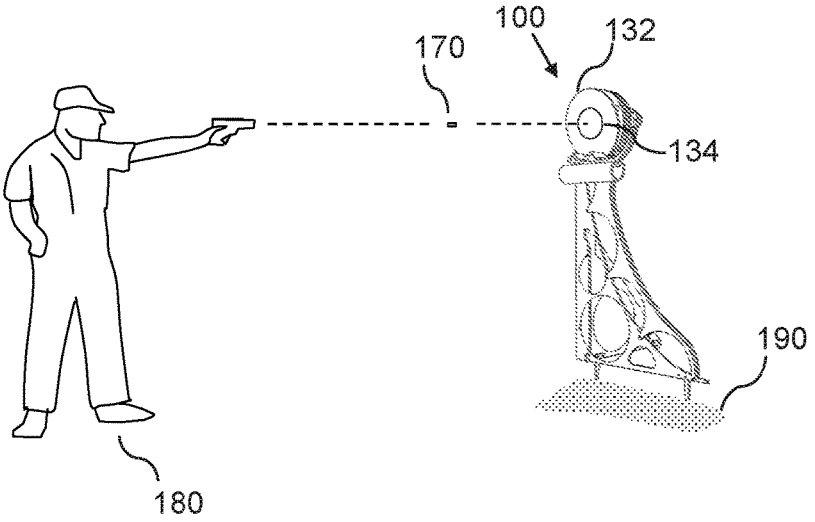
FIG. 1A is a perspective view of an impact triggered dynamic target system in use, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an impact triggered dynamic target system 100 with reference to FIGS. 1A, 1B, 2A and 2B, in such manner that like reference numerals refer to like components throughout; a convention that we shall employ for the remainder of this specification.

Figure 1B:
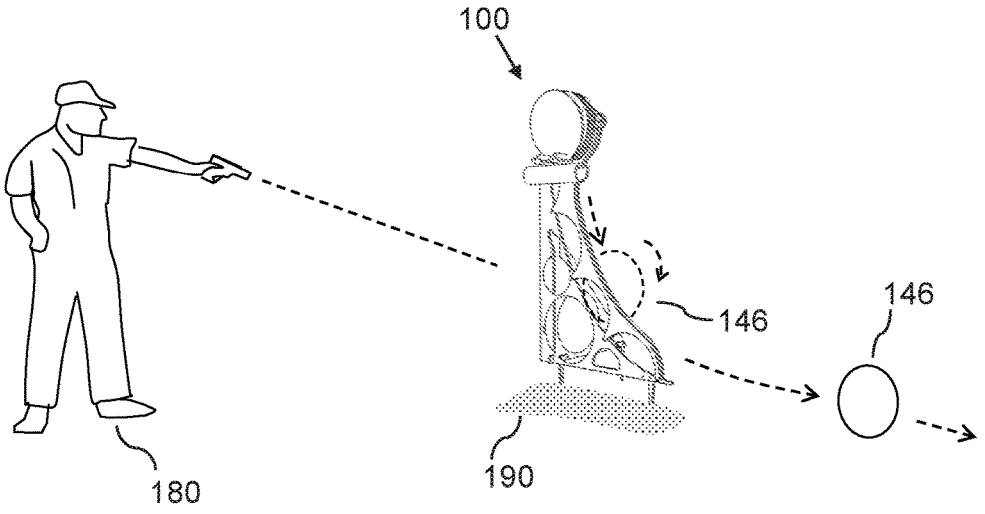
FIG. 1B is a perspective view of an impact triggered dynamic target system in use, according to an embodiment of the invention.

In an embodiment, FIGS. 1A and 1B show an impact triggered dynamic target system 100 in use, where in a target shooter/user 180 shoots at a static primary target disc 132, such that when the primary target disc 132 is impacted, a dynamic/moveable secondary target disc 146 is released, such that the secondary target disc 146 rolls off the impact triggered dynamic target system 100, and then rolls on a ground surface 190 adjacent to the impact triggered dynamic target system 100, such that the secondary target disc 146 rolls away from the impact triggered dynamic target system 100, such that the target shooter/user 180 can shoot at the secondary target disc 146, while the secondary target disc 146 is rolling on the ground.

Figure 2A:
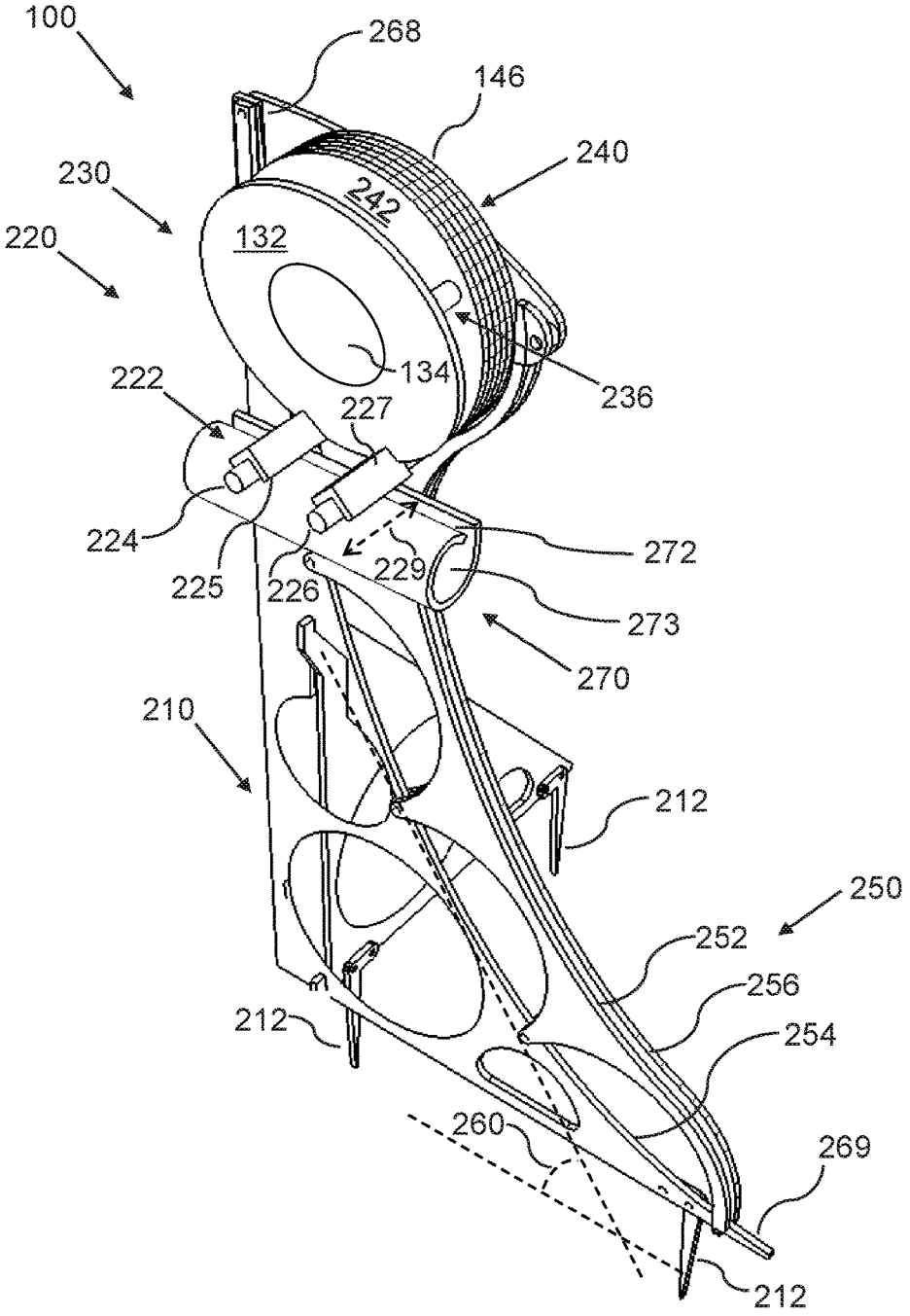
FIG. 2A is a perspective view of an impact triggered dynamic target device, according to an embodiment of the invention.
Figure 2B:
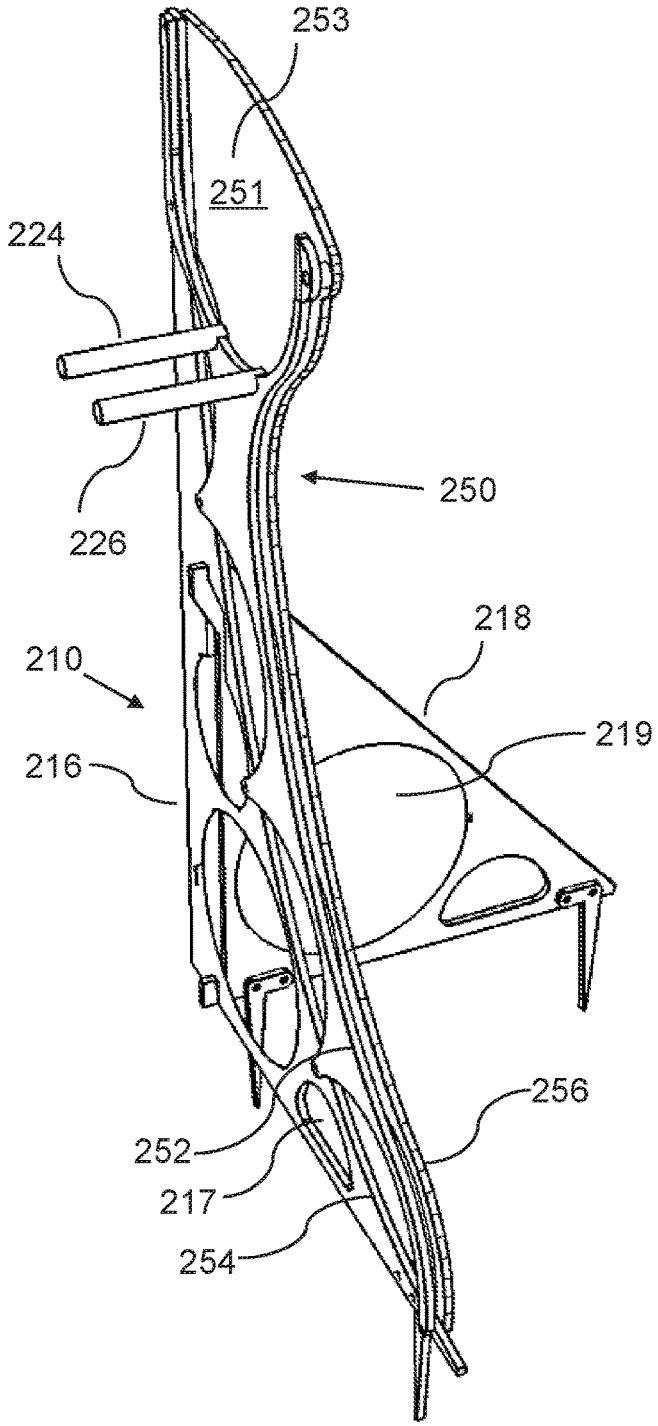
FIG. 2B is a perspective view of a parts of an impact triggered dynamic target device, according to an embodiment of the invention.
Figure 3:
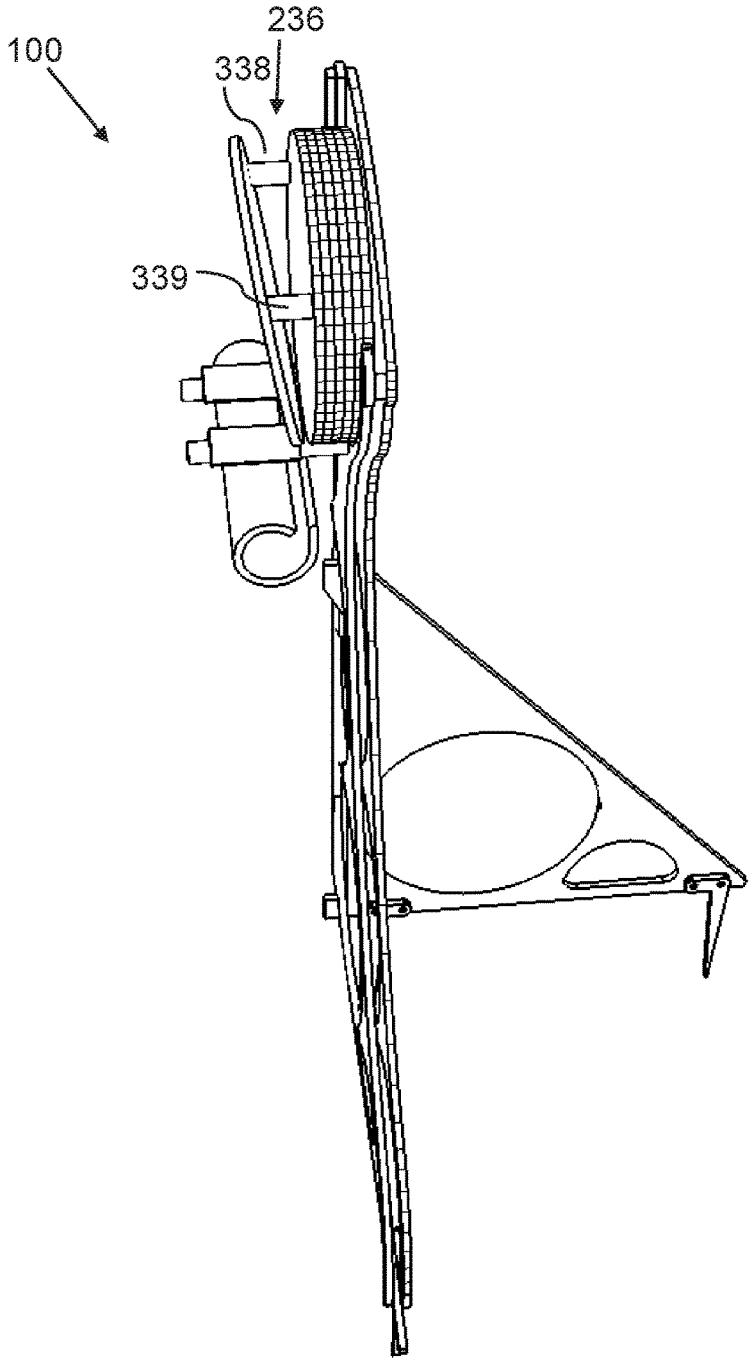
FIG. 3 is a right perspective view of an impact triggered dynamic target device, according to an embodiment of the invention.
Figure 4:
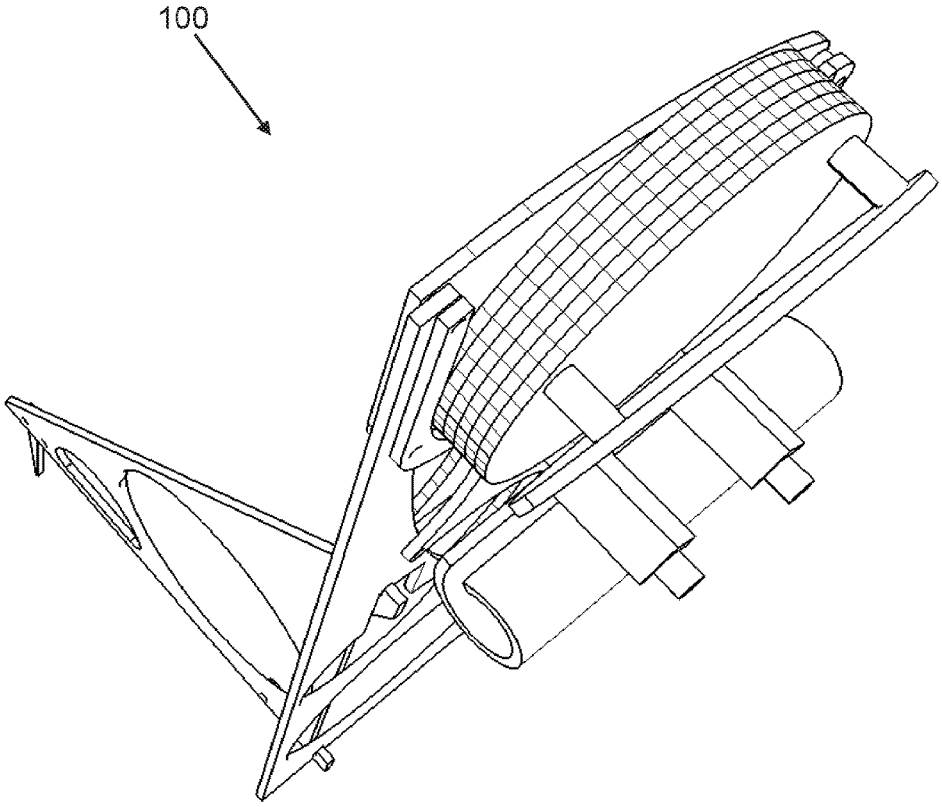
FIG. 4 is a top perspective view of an impact triggered dynamic target device, according to an embodiment of the invention.

In an embodiment, as shown in FIGS. 2A and 2B, an impact triggered dynamic target system 100 can include:

a) A target body 210, including:
   i. Legs 212, which can be ground spikes 212, for positioning the impact triggered dynamic target system 100 stably on the ground; and b) A target release assembly 220, which can be mounted to an upper part of the target body, the target release assembly 220 including:
   i. A target holder 222, which can include:
      1. A first holder peg 224; and
      2. A second holder peg 226;
   ii. A primary target assembly 230, including:
      1. A primary target disc 132;
      2. A secondary target pusher 236, which can be mounted on a rear side of an upper end of the primary target disc 132, such that the secondary target pusher 236 protrudes rearward, wherein the secondary target pusher 236 can include:
         A first secondary target pusher part 338; and
         A second secondary target pusher part 339;
         Wherein the first and second secondary target pusher parts 338 339 are mounted side by side on respectively a right and left side of the rear side of the upper end of the primary target disc, such that the first and second secondary target pushers protrude rearward;
      3. A first target slider 225, which can be connected to a lower end of the primary target disc 132, such that the first target slider 225 is slidably 229 mounted on the first holder peg 224; and
      4. A second target slider 227, which can be connected to a lower end of the primary target disc 132, such that the second target slider 227 is slidably 229 mounted on the second holder peg 226;
   iii. A projectile receptacle 270, which can be connected to the target body 210 below the primary target disc 132, such that the projectile receptacle 270 is configured to receive a projectile 170, after the projectile 170 impacts with the primary target disc 132; and
   iv. A plurality of secondary target discs 240, which can be horizontally stacked adjacent to a rear end of the primary target assembly 230 (i.e. on a rear side of the primary target disc 132), such that a front disc 242 of the secondary target discs 240 is immediately adjacent to (and potentially in contact with) the rear end of the primary target assembly 230;

such that the primary target assembly 230 and the secondary target discs 240 can be slidably 229 resting on (i.e. positioned on)/coupled to a top of the target holder 222, such that the primary target assembly 230 and the secondary target discs 240 are configured to slide 229 horizontally along the target holder 222 in a forward or rearward direction; and c) A rolling track 250, which can be connected to or integral with the target body 210, such that the rolling track 250 is oriented downward toward a ground surface 190 from a rear of the plurality of secondary target discs 240, such that the rolling track is configured to allow a rear disc 146 of the plurality of secondary target discs 240 to roll toward the ground surface 190, such that the rolling track 250 can include:
   i. An entry region 253;
   ii. A rolling surface 254, which can be an edge of the target body 210, such that the entry region provides access for the rear disc 146 to enter/contact with the rolling surface 254;
   iii. A first side rail 252; and
   iv. A second side rail 256;
   wherein the first and second side rails 252 256 can be mounted on opposing sides of the rolling surface 254, such that the first and second side rails 252 256 are configured to keep the rear disc 146 upright when the rear disc 146 rolls along the rolling track 250;

such that when target shooter/user 180 shoots at the primary target disc 132 and the primary target disc 132 is impacted by a projectile 170, the primary target disc 132 thereby pushes the secondary target pusher 236 rearward, such that the secondary target pusher 236 impacts with the front disc 242, and in general such that the primary target assembly 230 impacts with the front disc 242, and pushes the front disc 242 rearward, which pushes the secondary target discs 240 rearward, such that a rear disc 146 is pushed rearward into a rear wall 251 of the rolling track 250 such that the rear disc 146 enters the entry region 253 of the rolling track 250 without vertical support from the target holder 222 (i.e. there is no support to prevent the rear disc 146 from falling vertically downward), such that the rear disc 146 falls down into the rolling track 250 and contacts with the rolling surface 254, such that the rear disc 146 rolls down along the rolling track 250, such that the rear disc 146 rolls off the impact triggered dynamic target system 100, and then rolls on a ground surface 190 adjacent to the impact triggered dynamic target system 100, such that the secondary target rear disc 146 rolls away from the impact triggered dynamic target system 100, such that the target shooter/user 180 can shoot at the secondary target/rear disc 146, while the secondary target/rear disc 146 is rolling on the ground surface 190.

In a related embodiment, the primary target disc 132 can be connected to the first and second target sliders 225 227 with a forward inclination angle, such that the forward inclination angle ensures that the projectile bounces off the primary target disc 132 and is directed into the projectile receptacle 270.

In a related embodiment, the projectile receptacle 270 can be configured as a rolled/curled sheet 270 having a generally spiral curvature with an upper opening 272 that provides access to a receptacle interior 273 of the projectile receptacle 270, such that a first end of the rolled sheet 270 can be attached to the primary target assembly 230 (or alternatively the target body 210), such that the rolled sheet 270 is curled back, with a second end of the curled sheet 270 pointing toward the first end, with the upper opening 272 between the first and second ends. The projectile 170 may ricochet downward after impacting the primary target disc 132 and may enter the projectile receptacle 270 substantially tangentially with the first end of the rolled sheet 270 such that the projectile 170 is redirected along the spiral path of the rolled sheet 270, thereby trapping the projectile 170 within the receptacle interior 273 of the projectile receptacle 270.

Figure 8:
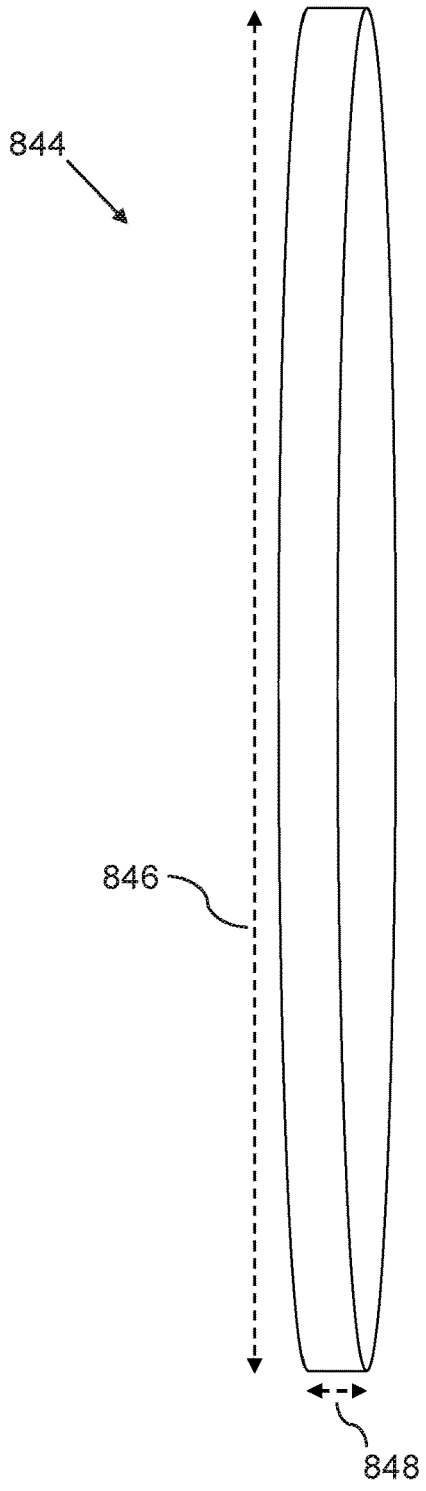
FIG. 8 is a side perspective view of a target disk, according to an embodiment of the invention.

In another related embodiment, the secondary target discs 240 may be sized such that they have sufficient gyroscopic stability to maintain balance when rolling on the ground surface 190 after exiting the rolling track 250, while at the same time having sufficient instability to rapidly fall over in response to an impact by a projectile 170, thereby providing visual feedback to the target shooter 180. In a further related embodiment, as shown in FIG. 8, It has been discovered by experimentation that the amount of stability most suitable for target use may be achieved when a diameter 846 of each target disc 844 is between 20 and 50 times a thickness 848 of the target disc 844.

In a related embodiment, the target release assembly 220 can be trimmed/balanced, such that an impact with a projectile 170 will only cause release of a rear disc 146 when the projectile impacts with the primary target disc 132 within a target area 134 (also called the sweet spot 134) of the primary target disc 132, because if the projectile 170 impacts outside the target area 134 this will cause a sufficient torque to twist the secondary target discs 240 which causes the secondary target discs 240 to lock in place instead of sliding rearward. The size of the target area can be determined by experimentation and is dependent on the specific configuration of the impact triggered dynamic target system 100, including the size and weight of the primary target assembly 230, the projectile receptacle 270, and the secondary target discs 240.

Thus, in a further related embodiment, the primary target disc 132 can be configured to indicate the target area 134, for example as a marking 134 which can be painted or drawn or an overlay sheet with a picture of the target area 134, such that an impact with a projectile 170 will only cause release of a rear disc 146 when the projectile impacts with the primary target disc 132 within the target area 134.

In another related embodiment, the rolling surface 254 can be configured as an elliptical curve, which changes smoothly from an initial rolling angle 268 that is substantially or near vertical, such as for example in a range of 70-90 degrees, to an exit rolling angle 269 that is near or substantially parallel with the ground surface, for example with an exit rolling angle 269 in a range of 0-20 degrees. FIG. 2A shows the rolling angle 260 at an intermediate position of the rolling surface 254.

In a related embodiment, as shown in FIG. 2B, the target body 210, can include:

a) a main body 216, which can be substantially parallel to a plane of the front disc 242, such that the main body 216 can be configured as a modified right triangle, wherein the hypotenuse is an elliptical hypotenuse in the form of a substantially elliptically or parabolically curved edge 254, which can function as (i.e. is) the rolling track 254 and b) a stabilizer flange 218, which is perpendicularly connected to a rear of the main body, such that the stabilizer flange can be configured as a triangle, which can be a right triangle.

In a further related embodiment, both the main body 216 and the stabilizer flange 218 can be configured with at least one hole/cutout 217 219, or a plurality of holes 217 219, to reduce weight.

Figure 5:
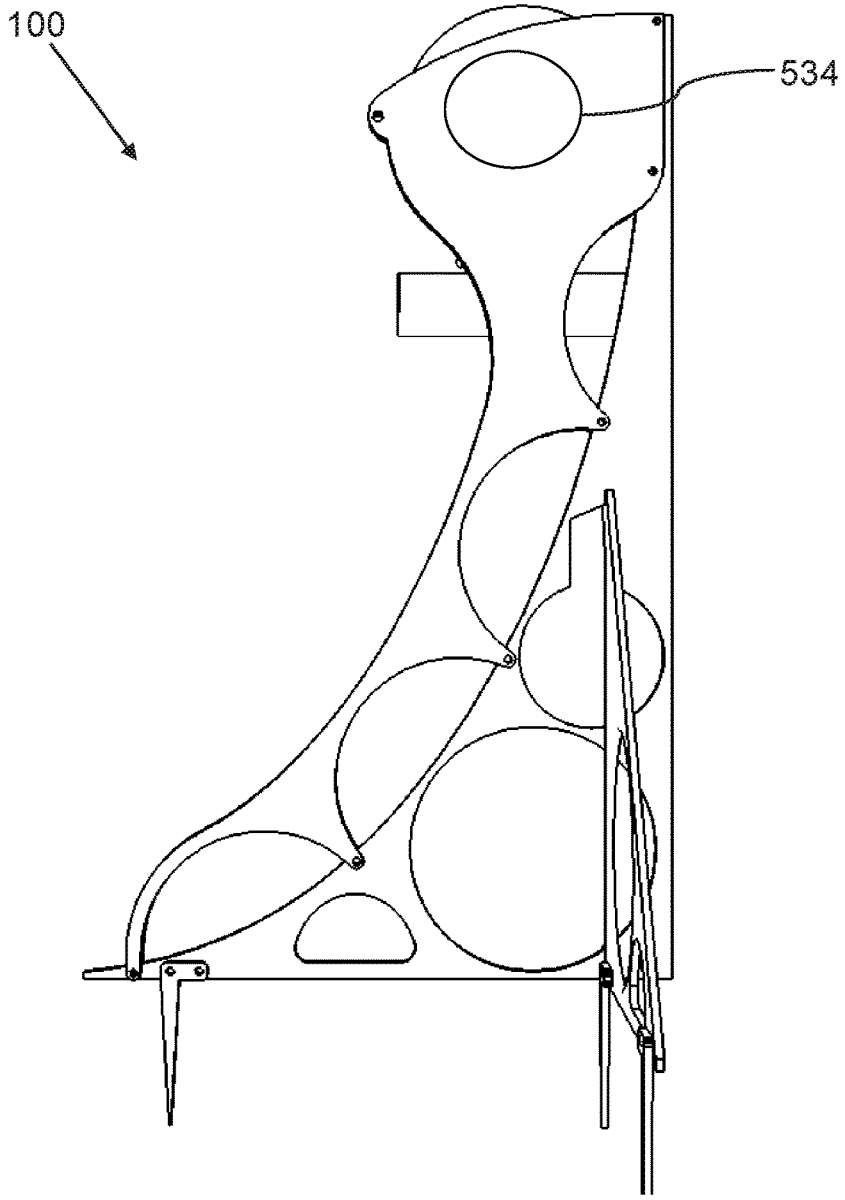
FIG. 5 is a rear perspective view of an impact triggered dynamic target device, according to an embodiment of the invention.
Figure 6:
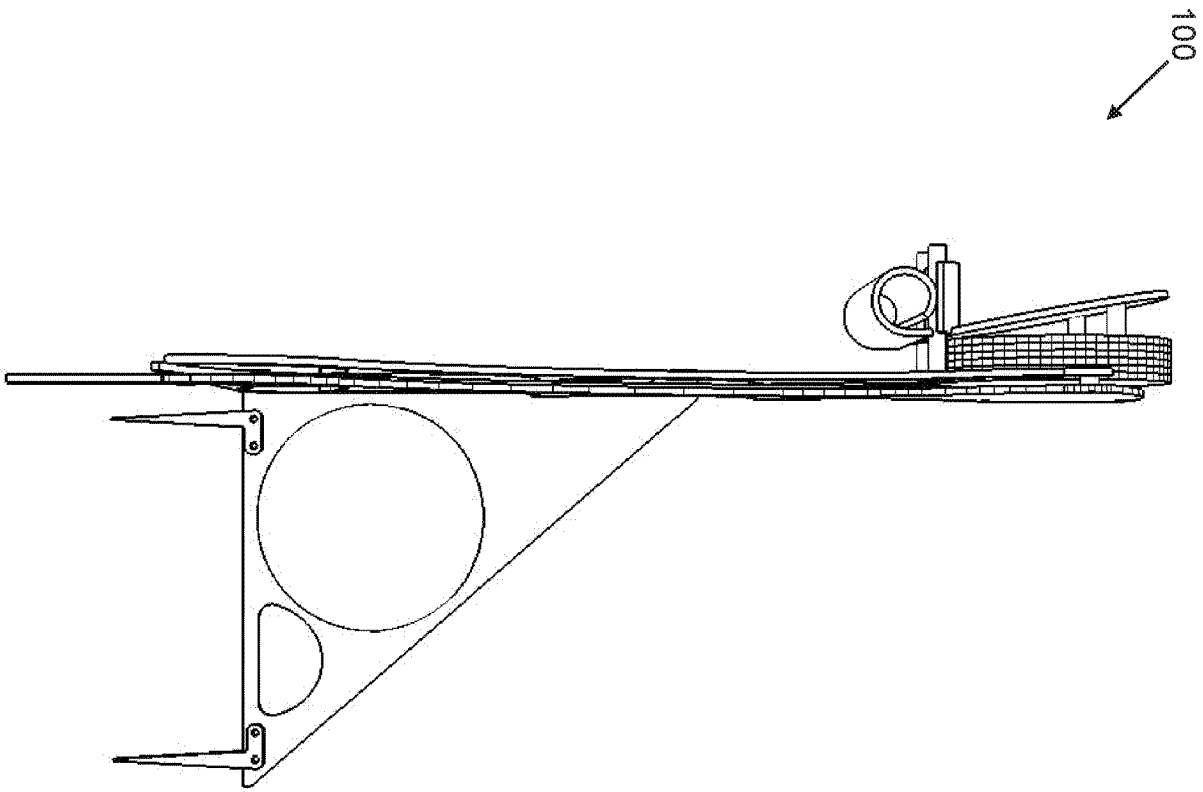
FIG. 6 is a side perspective view of an impact triggered dynamic target device, according to an embodiment of the invention.

In a related embodiment, the impact triggered dynamic target system 100 may be triggered by an impact directed at the target body 210 or a designated portion thereof rather than at the primary target disc 132. In this embodiment, the projectile 170 is caused to strike the target body 210, on a rear side of the target body, as shown in FIG. 5, from a direction opposite the primary target disc 132 such that the target body 210 is caused to move toward the secondary target discs 240, which have sufficient inertia to resist sudden acceleration. This causes the entry region 253 of the rolling track 250 without vertical support from the target holder 222 to move under the rear disc 146 of the secondary target discs 240 such that the rear disc 146 falls down into the rolling track 250, such that the rear disc 146 rolls down along the rolling track 250, such that the rear disc 146 rolls off the impact triggered dynamic target system 100, and then rolls on a ground surface 190 adjacent to the impact triggered dynamic target system 100, such that the secondary target rear disc 146 rolls away from the impact triggered dynamic target system 100, such that the target shooter/user 180 can shoot at the secondary target/rear disc 146, while the secondary target/rear disc 146 is rolling on the ground surface 190.

In a further related embodiment, as shown in FIG. 5, a rear side of the target body 210 can be configured with a marking to indicate a rear target area 534, such that an impact with the projectile in the target area 534 causes release of the rear disc. The target can be in an upper rear side of the target body 210 on an opposite side of the plurality of secondary target discs 240. The size and position of the rear target area 534 can be determined by experimentation and is dependent on the specific configuration of the impact triggered dynamic target system 100, including the size and weight of the primary target assembly 230, the projectile receptacle 270, and the secondary target discs 240.

It will be appreciated by those skilled in the art that adjustments to the angle of the target holder 222 or elements thereof relative to the target body 210 might be made to facilitate practical implementation of the impact triggered dynamic target system 100 and/or to adjust the performance thereof. Accordingly, the description of the plurality of secondary target discs 240 as horizontally stacked shall be interpreted as descriptive of the general stacking configuration of secondary target discs 240 and should not be interpreted in a limiting sense or as a requirement for angular precision. Likewise, it will be appreciated by those skilled in the art that the impact triggered dynamic target system 100 might be successfully used in a variety of environments, both indoors and outdoors. Accordingly, the terms "ground" and "ground surface" as used herein shall be understood to embrace any surface, whether natural or artificial, preexisting or specially constructed (such as a track), upon which the secondary target discs 240 may be allowed to roll after exiting the rolling track 250. In addition, it will be appreciated by those skilled in the art that the primary target disc 132 may or may not be circular in shape. The primary target disc 132 may, without limitation, be circular, elliptical, oval, triangular, square, rectangular, or hexagonal. Therefore, the designation as a "disc" should not be construed in a limiting sense. Furthermore, the term substantially elliptical shall be interpreted as any shape with less than 20% deviation from a true ellipse.

In a related embodiment, FIGS. 3, 4, 5, and 6 show various views of the impact triggered dynamic target system 100.

Figure 7A:
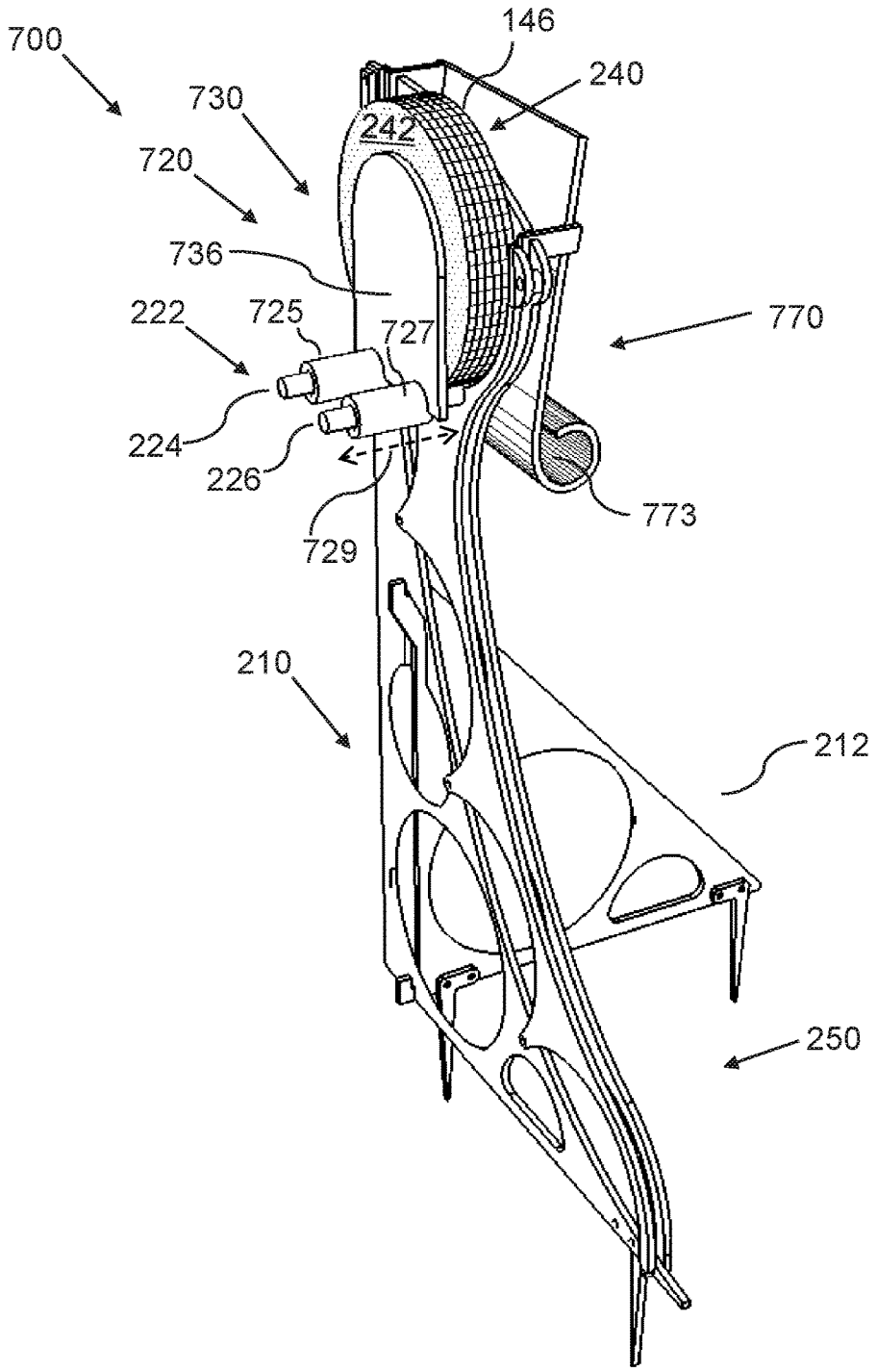
FIG. 7A is a front perspective view of an impact triggered dynamic target device, according to an embodiment of the invention.
Figure 7B:
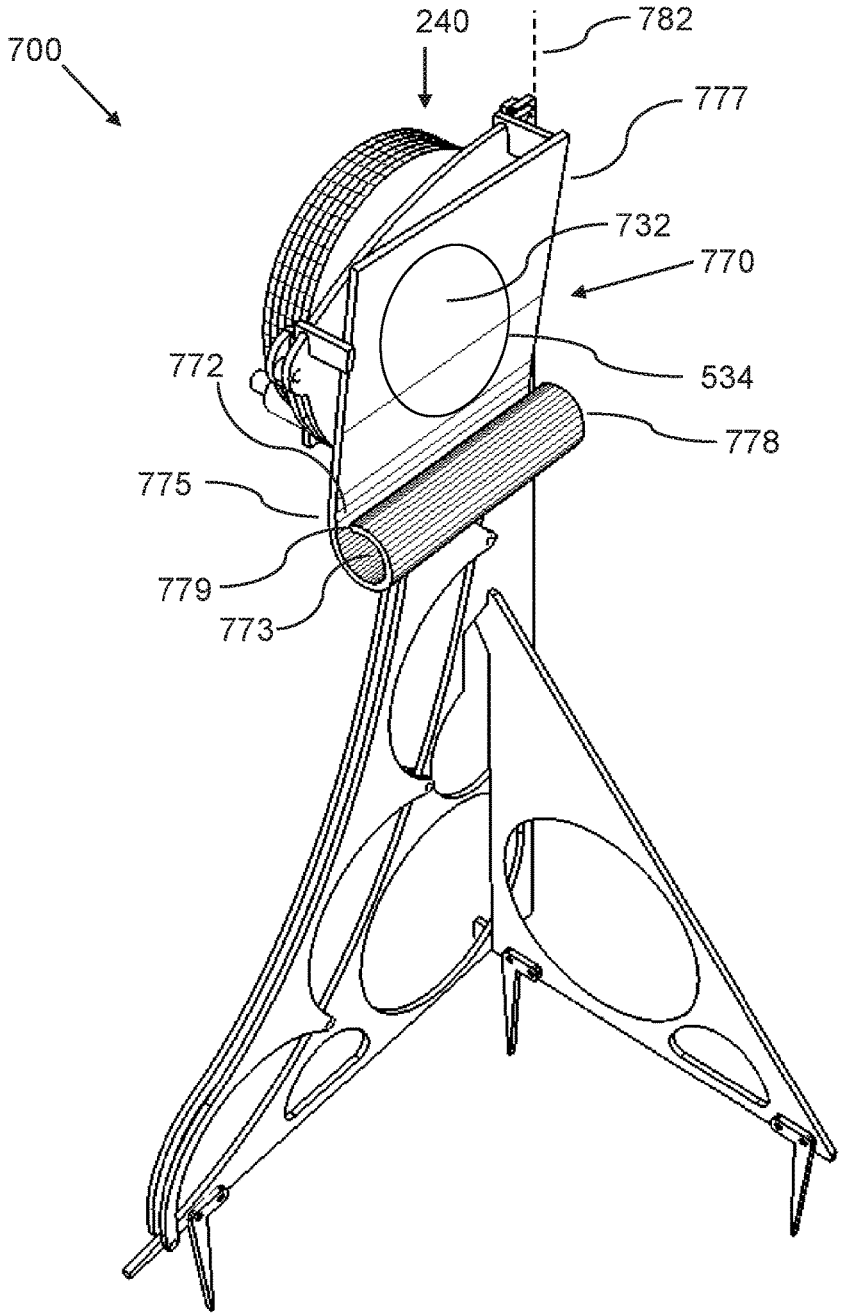
FIG. 7B is a rear perspective view of an impact triggered dynamic target device, according to an embodiment of the invention.
Figure 7C:
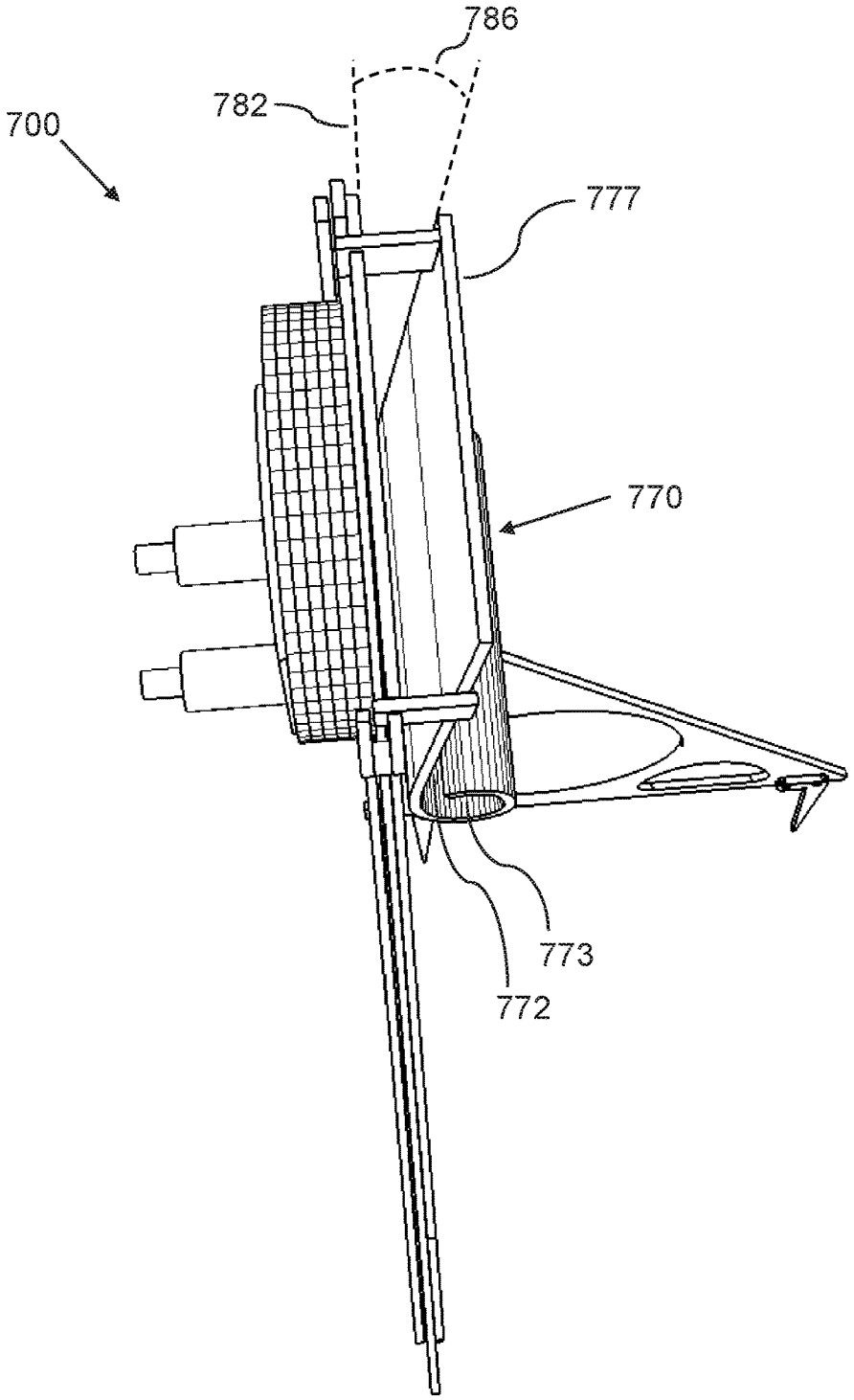
FIG. 7C is a top perspective view of an impact triggered dynamic target device, according to an embodiment of the invention.

In a related embodiment, as shown in FIGS. 7A, 7B and 7C, an impact triggered dynamic target system 700 can include:

a) A target body 210, including:
   ii. Legs 212, which can be ground spikes 212, for positioning the impact triggered dynamic target system 100 stably on the ground; and b) A target release assembly 720, which can be mounted on a first/front side of an upper part of the target body 210, the target release assembly 220 including:
   i. A target holder 222, which can include:
      1. A first holder peg 224; and
      2. A second holder peg 226;
   ii. A target stabilizer 730, including:
      1. A first target slider 725, which can be slidably mounted on (or connected to) the first holder peg 224;
      2. A second target slider 727, which can be slidably mounted on (or connected to) the second holder peg 226; and
      3. A vertical stabilizer 736, which can be connected to the first and second target sliders 725 727, such that the vertical stabilizer 736 protrudes upwards; and
   iii. A plurality of target discs 240, which can be horizontally stacked adjacent to a second/rear side of the target stabilizer 730, such that a front disc 242 of the target discs 240 is immediately adjacent to (and potentially in contact with) a rear side of the vertical stabilizer 736;

such that the target stabilizer 730 and the target discs 240 can be slidably 729 resting on (i.e. positioned on)/coupled to the target holder 222, such that the target stabilizer 730 and the target discs 240 are configured to slide 729 horizontally along the target holder 222 in a forward or rearward direction;

c) a target area 732, which can be positioned on an opposite second side of the upper part of the target body 210;

d) A projectile receptacle 770, which can be mounted on the opposite second side of the upper part of the target body 210, such that the projectile receptacle 770 is configured to receive a projectile, after the projectile impacts with the target area 732; and e) A rolling track 250, which can be connected to or integral with the target body 210, such that the rolling track 250 is oriented downward toward a ground surface 190 from a rear of the plurality of secondary target discs 240, such that the rolling track is configured to allow a rear disc 146 of the plurality of secondary target discs 240 to roll toward the ground surface 190, the rolling track 250 including:
   i. An entry region 253;
   ii. A rolling surface 254, which can be an edge of the target body 210, such that the entry region provides access for the rear disc 146 to enter/contact with the rolling surface 254;
   iii. A first side rail 252; and
   iv. A second side rail 256;
   wherein the first and second side rails 252 256 can be mounted on opposing sides of the rolling surface 254, such that the first and second side rails 252 256 are configured to keep the rear disc 146 upright when the rear disc 146 rolls along the rolling track 250;

whereby when the target area 732 is impacted by a projectile 170, the target body 210 is caused to move toward the target discs 240, which have sufficient inertia to resist sudden acceleration, such that the entry region 253 of the rolling track 250 moves under the rear disc 146 of the target discs 240, such that the rear disc 146 falls down into the rolling track 250, such that the rear disc 146 falls down into the rolling track 250 and contacts with the rolling surface 254, such that the rear disc 146 rolls down along the rolling track 250, such that the rear disc 146 rolls off the impact triggered dynamic target system 100, and then rolls on a ground surface 190 adjacent to the impact triggered dynamic target system 100, such that the secondary target rear disc 146 rolls away from the impact triggered dynamic target system 100, such that the target shooter/user 180 can shoot at the secondary target/rear disc 146, while the secondary target/rear disc 146 is rolling on the ground surface 190.

In a related embodiment, as shown in FIGS. 7A, 7B and 7C, the projectile receptacle 770 can be configured to include the target area 732, such that the projectile receptacle 770 can be configured as a single sheet with a flat upper part 777 that includes the target area 732, and a rolled/curled lower part 778 having a generally spiral curvature with an upper opening 772, such that the lower part 778 of the rolled sheet 770 is curled back, with a lower end 779 of the curled sheet 770 pointing toward the target body 210, thereby forming an upper opening 772 between the lower end 779 and a central part 775 of the projectile receptacle 770, such that the upper opening 772 provides access to a receptacle interior 773. The projectile 170 may ricochet downward after impacting the primary target disc 132 and may enter the projectile receptacle 770 substantially tangentially with the first end of the rolled sheet 770 such that the projectile 170 is redirected along the spiral path of the rolled sheet 770, thereby trapping the projectile 170 within the lower part 778 of the projectile receptacle 770.

In a related embodiment, as shown in FIG. 7C, the flat upper part 777 can be configured with a rearward inclination angle 786 relative to a vertical orientation 782, such that the rearward inclination angle 786 ensures that the projectile bounces off the target area 732 and is directed into the receptacle interior of the projectile receptacle 770. In further related embodiments, the rearward inclination angle 786 can be in a range of 5 to 35 degrees.

In a related embodiment, as shown in FIGS. 7A, 7B and 7C, the first and second target sliders 725 727 can be cylindrical hollow tubes, such that the first and second target sliders 725 727 slide onto respectively the first and second holder pegs 224 226, with the first and second holder pegs 224 226 protruding through respectively the first and second target sliders 725 727.

In a related embodiment, as shown in FIG. 2A, the first and second target sliders 225 227 can be elongated L-shaped members (that can also be described as elongated v-shaped members), such that the first and second target sliders 725 727 slide on and along respectively the first and second holder pegs 224 226, with the first and second target sliders 725 727 positioned on top of/resting on the first and second holder pegs 224 226. Alternatively, the first and second target sliders 225 227 can be semi-cylindrical or fully cylindrical hollow tubes, or some other shape that is configured to slidably rest on or be slidably coupled to the first and second holder pegs 224 226.

In an embodiment, an impact triggered dynamic target system for use by a target shooter can include:

a) a target body;

b) a target release assembly, which is mounted to an upper part of the target body, the target release assembly comprising:

a target holder;

a primary target assembly, including:

a primary target disc; and a plurality of secondary target discs, which are horizontally stacked adjacent to a rear end of the primary target assembly, such that a front disc of the secondary target discs is immediately adjacent to a rear end of the primary target assembly;

such that the primary target assembly and the secondary target discs are slidably coupled to the target holder; and c) a rolling track, which is connected to the target body, the rolling track comprising an entry region adjacent to a rear of the target discs and a rolling surface; and whereby when the primary target disc is impacted by a projectile, the primary target disc thereby pushes the primary target assembly rearward, such that the primary target assembly impacts with the front disc, and pushes the front disc rearward, which pushes the secondary target discs rearward, such that a rear disc of the secondary target discs is pushed rearward, such that the rear disc enters the entry region of the rolling track, such that the rear disc falls down into the rolling track and contacts with the rolling surface, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter is enabled to shoot at the rear disc, while the rear disc is rolling on the ground surface.

In a related embodiment, the target body can further include legs, for positioning the impact triggered dynamic target system stably on the ground surface, wherein the legs are configured as ground spikes.

In a related embodiment, the target holder can further include:

a) a first holder peg; and b) a second holder peg;

such that the primary target assembly and the secondary target discs are slidably positioned on a top of the first and second holder pegs.

In a further related embodiment, the primary target assembly can further include:

a) a first target slider, which is connected to a lower end of the primary target disc, such that the first target slider is slidably mounted on the first holder peg; and b) a second target slider, which is connected to a lower end of the primary target disc, such that the second target slider is slidably mounted on the second holder peg.

In a related embodiment, the first and second target sliders can be cylindrical hollow tubes, such that the first and second target sliders are configured to slide onto respectively the first and second holder pegs, with the first and second holder pegs protruding through respectively the first and second target sliders.

In a related embodiment, the rolling track can be an edge of the target body.

In a related embodiment, the rolling track can further include:

a) a first side rail; and b) a second side rail;

wherein the first and second side rails are mounted on opposing sides of the rolling surface, such that the first and second side rails are configured to keep the rear disc upright when the rear disc rolls along the rolling track.

In a related embodiment, the impact triggered dynamic target system can further include:

a projectile receptacle, which is connected to the target body below the primary target disc, such that the projectile receptacle is configured to receive the projectile, after the projectile impacts with the primary target disc.

In a further related embodiment, the projectile receptacle can be configured as a rolled sheet with an upper opening that provides access to a receptacle interior.

In another further related embodiment, the primary target assembly can further include:

a secondary target pusher, which is mounted on a rear side of an upper end of the primary target disc, such that the secondary target pusher protrudes rearward;

wherein the primary target disc is positioned with a forward inclination angle, such that the forward inclination angle ensures that the projectile bounces off the primary target disc and is directed into the projectile receptacle.

In a yet further related embodiment, the secondary target pusher can further include:

a) a first secondary target pusher part; and b) a second secondary target pusher part;

wherein the first and second secondary target pusher parts are mounted side by side on respectively a right and left side of the rear side of the upper end of the primary target disc, such that the first and second secondary target pusher parts protrude rearward.

In a related embodiment, the primary target disc can be configured with a marking to indicate a target area, such that an impact with the projectile will only cause release of the rear disc when the projectile impacts with the primary target disc within the target area.

In another related embodiment, the rolling surface can be configured as an elliptical curve, which changes smoothly from an initial rolling angle to an exit rolling angle.

In a further related embodiment, the initial rolling angle can be in a range of 70-90 degrees and the exit rolling angle can be in a range of 0-20 degrees.

In a related embodiment, the target body can include:

a main body, which is configured as a modified right triangle with an elliptical hypotenuse, such that the elliptical hypotenuse is the rolling track.

In a related embodiment, the target body can include:

a) a main body; and b) a stabilizer flange, which is perpendicularly connected to a rear of the main body.

In a related embodiment, a rear side of the target body can be configured with a marking to indicate a rear target area, such that an impact with the projectile in the target area causes release of the rear disc.

In an embodiment, an impact triggered dynamic target system for use by a target shooter can include:

a) a target body;

b) a target release assembly, which is mounted to an upper part of the target body, the target release assembly comprising:

a primary target assembly, including:

a primary target disc; and a plurality of secondary target discs, which are horizontally stacked adjacent to a rear end of the primary target assembly, such that a front disc of the secondary target discs is immediately adjacent to a rear end of the primary target assembly;

such that the primary target assembly and the secondary target discs are slidably connected to the target body; and c) a rolling track, which is connected to the target body, the rolling track comprising an entry region adjacent to a rear of the target discs and a rolling surface; and whereby when the primary target disc is impacted by a projectile, the primary target disc thereby pushes the primary target assembly rearward, such that the primary target assembly impacts with the front disc, and pushes the front disc rearward, which pushes the secondary target discs rearward, such that a rear disc of the secondary target discs is pushed rearward, such that the rear disc enters the entry region of the rolling track, such that the rear disc falls down into the rolling track and contacts with the rolling surface, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter is enabled to shoot at the rear disc, while the rear disc is rolling on the ground surface.

In another embodiment, an impact triggered dynamic target system for use by a target shooter can include:

a) a target body;

b) a target release assembly, which is mounted on a first side of an upper part of the target body, the target release assembly comprising:

a target holder;

a target stabilizer, including:

a vertical stabilizer; and a plurality of target discs, which are horizontally stacked adjacent to a rear side of the target stabilizer, such that a front disc of the target discs is immediately adjacent to a rear side of the vertical stabilizer;

such that the target stabilizer and the target discs are slidably coupled to the target holder;

c) a target area, which is positioned on an opposite second side of the upper part of the target body; and d) a rolling track, which is connected to the target body, the rolling track comprising an entry region adjacent to a rear of the target discs and a rolling surface; and whereby when the target area is impacted by a projectile, the target body moves toward the target discs, such that the entry region of the rolling track moves under a rear disc of the target discs, such that the rear disc falls down into the rolling track and contacts with the rolling surface, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter is enabled to shoot at the rear disc, while the rear disc is rolling on the ground surface.

In a related embodiment, the impact triggered dynamic target system can further include a projectile receptacle such that the projectile receptacle is configured as a single sheet with a flat upper part that includes the target area, and a curled lower part having a generally spiral curvature, such that the curled lower part is curled back, with a lower end of the curled sheet pointing toward the target body, thereby forming an upper opening between the lower end and a central part of the projectile receptacle, such that the upper opening provides access to a receptacle interior.

Here has thus been described a multitude of embodiments of the impact triggered dynamic target system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. An impact triggered dynamic target system for use by a target shooter, the impact triggered dynamic target system comprising:

a) a target body;

b) a target release assembly, which is mounted to an upper part of the target body, the target release assembly comprising:

a target holder;

a primary target assembly, comprising:

a primary target disc; and a plurality of secondary target discs, which are horizontally stacked adjacent to a rear end of the primary target assembly, such that a front disc of the secondary target discs is immediately adjacent to the rear end of the primary target assembly;

such that the primary target assembly and the secondary target discs are slidably coupled to the target holder; and c) a rolling track, which is connected to the target body, the rolling track comprising an entry region adjacent to a rear of the secondary target discs and a rolling surface;

whereby when the primary target disc is impacted by a projectile, the primary target disc thereby pushes the primary target assembly rearward, such that the primary target assembly impacts with the front disc, and pushes the front disc rearward, which pushes the secondary target discs rearward, such that a rear disc of the secondary target discs is pushed rearward, such that the rear disc enters the entry region of the rolling track, such that the rear disc falls down into the rolling track and contacts with the rolling surface, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter is enabled to shoot at the rear disc, while the rear disc is rolling on the ground surface.

2. The impact triggered dynamic target system of claim 1, wherein the rolling track further comprises first and second side rails mounted on opposing sides of the rolling surface.

3. The impact triggered dynamic target system of claim 1, wherein the rolling track is an edge of the target body.

4. The impact triggered dynamic target system of claim 1, wherein the rolling surface is configured as a substantially elliptical curve, which changes smoothly from an initial rolling angle to an exit rolling angle.

5. The impact triggered dynamic target system of claim 4, wherein the initial rolling angle is in a range of 70-90 degrees.

6. The impact triggered dynamic target system of claim 1, wherein a diameter of each secondary target disc in the plurality of secondary target discs is between 20 and 50 times a thickness of the secondary target disc.

7. An impact triggered dynamic target system for use by a target shooter, the impact triggered dynamic target system comprising:

a) a target body;

b) a target release assembly, which is mounted on a first side of an upper part of the target body, the target release assembly comprising:

a target holder;

a target stabilizer, comprising:

a vertical stabilizer; and a plurality of target discs, which are horizontally stacked adjacent to a rear side of the target stabilizer, such that a front disc of the target discs is immediately adjacent to a rear side of the vertical stabilizer;

such that the target stabilizer and the target discs are slidably coupled to the target holder;

c) a target area, which is positioned on an opposite second side of the upper part of the target body; and d) a rolling track, which is connected to the target body, the rolling track comprising an entry region adjacent to a rear of the target discs and a rolling surface;

whereby when the target area is impacted by a projectile, the target body moves toward the target discs, such that the entry region of the rolling track moves under a rear disc of the target discs, such that the rear disc falls down into the rolling track and contacts with the rolling surface, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter is enabled to shoot at the rear disc, while the rear disc is rolling on the ground surface.

8. The impact triggered dynamic target system of claim 7, wherein the rolling track further comprises first and second side rails mounted on opposing sides of the rolling surface.

9. The impact triggered dynamic target system of claim 7, wherein the rolling track is an edge of the target body.

10. The impact triggered dynamic target system of claim 7, wherein the rolling surface is configured as a substantially elliptical curve, which changes smoothly from an initial rolling angle to an exit rolling angle.

11. The impact triggered dynamic target system of claim 10, wherein the initial rolling angle is in a range of 70-90 degrees.

12. The impact triggered dynamic target system of claim 7, wherein a diameter of each target disc in the plurality of target discs is between 20 and 50 times a thickness of the target disc.

13. An impact triggered dynamic target system for use by a target shooter, the impact triggered dynamic target system comprising:

a) a target body;

b) a target release assembly, which is mounted on an upper part of the target body, the target release assembly comprising:

a target holder; and a plurality of target discs, which are horizontally stacked and slidably coupled to the target holder; and c) a rolling track, which is connected to the target body, the rolling track comprising an entry region adjacent to a rear of the target discs and a rolling surface;

whereby when the impact triggered dynamic target system is impacted by a projectile, the rear disc enters the entry region of the rolling track, such that the rear disc falls down into the rolling track and contacts with the rolling surface, such that the rear disc rolls down along the rolling track, such that the rear disc rolls off the impact triggered dynamic target system, and then rolls on a ground surface adjacent to the impact triggered dynamic target system, such that the rear disc rolls away from the impact triggered dynamic target system, whereby the target shooter is enabled to shoot at the rear disc, while the rear disc is rolling on the ground surface.

14. The impact triggered dynamic target system of claim 13, wherein the target body comprises a target area, which is configured to be impacted by the projectile.

15. The impact triggered dynamic target system of claim 13, wherein the target release assembly further comprises a primary target assembly, the primary target assembly comprising a primary target disc, such that a front disc of the target discs is immediately adjacent to a rear end of the primary target assembly, and such that the primary target assembly is slidably coupled to the target holder; whereby when the primary target disc is impacted by the projectile, the primary target disc thereby pushes the primary target assembly rearward.

16. The impact triggered dynamic target system of claim 13, wherein the rolling track further comprises first and second side rails mounted on opposing sides of the rolling surface.

17. The impact triggered dynamic target system of claim 13, wherein the rolling track is an edge of the target body.

18. The impact triggered dynamic target system of claim 13, wherein the rolling surface is configured as a substantially elliptical curve, which changes smoothly from an initial rolling angle to an exit rolling angle.

19. The impact triggered dynamic target system of claim 18, wherein the initial rolling angle is in a range of 70-90 degrees.

20. The impact triggered dynamic target system of claim 13, wherein a diameter of each target disc in the plurality of target discs is between 20 and 50 times a thickness of the target disc.

* * * * *